US008919904B2

(12) United States Patent
Shirakawa et al.

(10) Patent No.: US 8,919,904 B2
(45) Date of Patent: Dec. 30, 2014

(54) INKJET RECORDING APPARATUS

(71) Applicant: Canon Kabushiki Kaisha, Tokyo (JP)

(72) Inventors: Hiroaki Shirakawa, Kawasaki (JP); Yuhei Oikawa, Yokohama (JP); Satoshi Hayashi, Yokohama (JP); Taku Yokozawa, Yokohama (JP); Masaki Nitta, Yokohama (JP); Yosuke Ishii, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/835,257

(22) Filed: Mar. 15, 2013

(65) Prior Publication Data

US 2013/0257933 A1 Oct. 3, 2013

(30) Foreign Application Priority Data

Mar. 29, 2012 (JP) ..... 2012-076561
Mar. 7, 2013 (JP) ..... 2013-045181

(51) Int. Cl.

*B41J 29/38* (2006.01)
*B41J 2/175* (2006.01)
*B41J 2/165* (2006.01)

(52) U.S. Cl.

CPC ..... *B41J 2/165* (2013.01); *B41J 2002/17569* (2013.01); *B41J 2002/16573* (2013.01); *B41J 2002/17589* (2013.01); *B41J 2/17566* (2013.01)
USPC ..... 347/14; 347/7

(58) Field of Classification Search

USPC ..... 347/14, 19, 22, 23, 29, 92, 7, 86
See application file for complete search history.

(56) References Cited

U.S. PATENT DOCUMENTS 6,161,913 A * 12/2000 Childers et al. ..... 347/19
2009/0231367 A1* 9/2009 Tsuchiya ..... 347/7
2010/0103229 A1* 4/2010 Ikushima ..... 347/85

FOREIGN PATENT DOCUMENTS

JP 2002-307712 A 10/2002

* cited by examiner

*Primary Examiner* — Julian Huffman
*Assistant Examiner* — Sharon A Polk
(74) *Attorney, Agent, or Firm* — Canon USA Inc IP Division

(57) ABSTRACT

An inkjet recording apparatus predicts the volume of air bubbles generated in a storage section of a recording head based on an input recording job. When the volume of the amount of ink in the storage section of the recording head is less than the predicted volume of air bubbles, a recovery operation is performed.

6 Claims, 11 Drawing Sheets

INKJET RECORDING APPARATUS

BACKGROUND OF THE INVENTION

1. Field of the Invention

Aspects of the present invention generally relate to an inkjet recording apparatus.

2. Description of the Related Art

As a system of supplying ink to a discharge port of an inkjet recording apparatus, a system of mounting an ink tank that contains ink on a carriage and supplying the ink, and a system of connecting an ink tank and an inkjet recording head by a supply tube and supplying the ink are known. In the case of a large-size inkjet recording apparatus that records a large image such as a poster, a large-capacitance ink tank is desired in order to reduce the frequency of replacing the ink tank. However, it is not preferable to mount such a large-capacitance ink tank on a carriage. Therefore, in the case of such an inkjet recording apparatus, a system of supplying ink via a supply tube is used.

Japanese Patent Laid-Open No. 2002-307712 discloses an inkjet recording apparatus capable of temporarily storing ink, supplied from an ink tank via an ink supply tube, in an ink storage section provided in a recording head. Japanese Paten Laid-Open No. 2002-307712 describes that more and more air bubbles are accumulated in an ink storage section as a recording operation is performed, which consequently results in incapability to discharge ink from a discharge port. It is disclosed to perform a recovery operation in every certain period.

An inkjet recording apparatus can perform recording on a record medium, such as an advertisement poster, which has a large size of A0, A1, or the like. Even during a recording operation of recording an image with such a size, it is necessary to perform control to prevent the occurrence of a discharging failure caused by air bubbles filling an ink storage section during recording.

However, as in Japanese Patent Laid-Open No. 2002-307712,the method of performing a recovery operation of the recording head in every certain period may not be able to perform a recovery operation at accurate timing. That is, ink may be discharged even when air bubbles are not accumulated in the ink storage section, or, on the contrary, ink may not be discharged due to the effect of air bubbles during a recording operation.

SUMMARY OF THE INVENTION

Aspects of the present invention relate to an inkjet recording apparatus capable of performing a highly-reliable recording operation that performs a recovery operation of a recording head at accurate timing.

According to an aspect of the present invention an inkjet recording apparatus includes a recording head including a row of discharge ports including a plurality of discharge ports configured to discharge ink, and a storage section configured to store ink to be discharged from the row of discharge ports, an obtaining unit configured to obtain an amount of ink in the storage section, a recovery unit configured to recover the recording head, a prediction unit configured to predict, based on an input recording job, a volume of air bubbles generated in the storage section, and a controller configured to perform control to cause the recovery unit to perform a recovery operation when the volume of the amount of ink is less than the volume of air bubbles.

Accordingly, a recovery operation can be performed when necessary, and hence, a highly-reliable recording operation can be performed.

Further features of the present invention will become apparent from the following description of exemplary embodiments with reference to the attached drawings.

DESCRIPTION OF THE EMBODIMENTS

First Embodiment

Figure 1A:
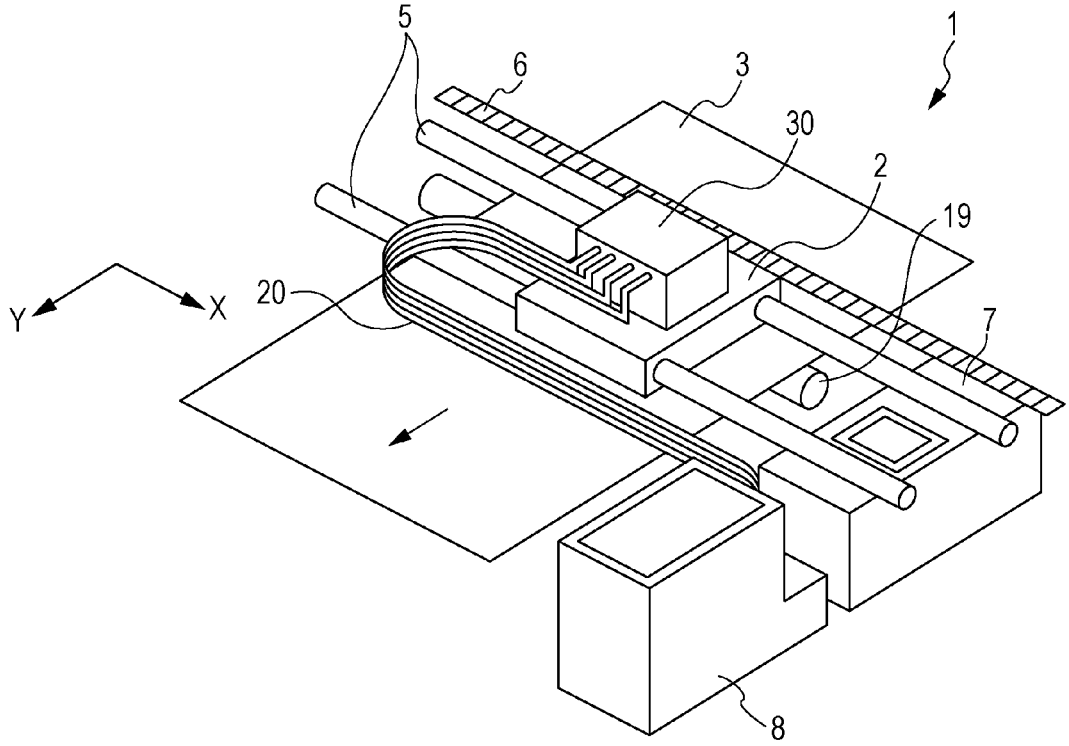
FIGS. 1A and 1B are schematic diagrams illustrating the structure of an inkjet recording apparatus and a recording head according to a first embodiment.

FIG. 1A illustrates a schematic perspective view of a recording apparatus body of an inkjet recording apparatus 1 that performs a recording operation on a record medium 3. Note that the inkjet recording apparatus of the present embodiment is a so-called serial-type inkjet recording apparatus that causes a recording head to perform reciprocal scanning in a recording width direction of the record medium 3 and performs a recording operation. The serial-type recording apparatus intermittently conveys the record medium 3 in the Y direction (sub scanning direction) by using a conveyance roller 19. Together with this, the serial-type recording apparatus performs a recording operation by causing a recording head 30 mounted on a carriage 2 to perform reciprocal scanning in the X direction (main scanning direction) that is a direction orthogonal to the Y direction, which is the direction in which the record medium 3 is conveyed. Also, the recording apparatus body illustrated in FIG. 1 is a large-size inkjet recording apparatus capable of performing recording on a record medium with a size of A0 or A1.

The recording head 30 is an inkjet recording head capable of discharging supplied ink from multiple discharge ports. The recording head 30 is detachably mounted on the carriage 2. The carriage 2 has the recording head 30 mounted thereon and performs reciprocal scanning along the X direction in FIG. 1. Specifically, the carriage 2 is movably supported along a guide rail 5 arranged along the X direction and is fixed by an endless belt 6 that moves in parallel to the guide rail 5. The endless belt 6 moves reciprocally in response to a driving force of a carriage motor (CR motor), thereby causing the carriage 2 to perform reciprocal scanning in the X direction.

Reference numeral 8 denotes an ink supply system. In the ink supply system 8, independent ink tanks 10 corresponding to colors of ink are provided. The ink supply system 8 and the recording head 30 are connected by ink supply tubes 20 made of flexible materials corresponding to the individual colors of ink. Further, by mounting the ink tanks 10 in the ink supply system 8, inks of the individual colors, contained in the ink tanks 10, can be independently supplied to the individual nozzle rows of the recording head 30.

The recording apparatus body also includes a recovery unit 7 including a suction cap 40 that recovers and maintains an ink discharge condition of the recording head 30, a preliminary discharge receiving section 41, and the like.

Figure 1B:
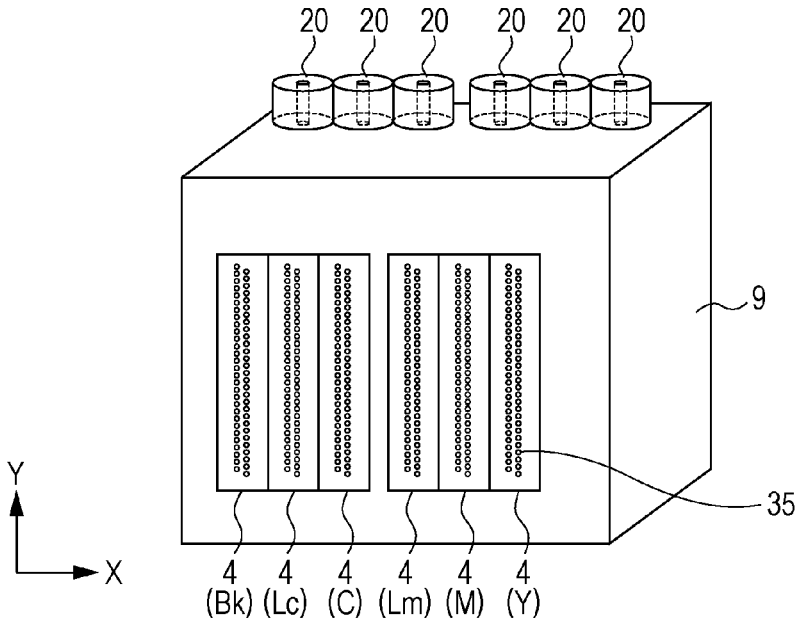

FIG. 1B is a diagram schematically illustrating a discharge port face of the recording head 30.

The recording head 30 includes recording head substrates 4 for the individual colors. Inks of the individual colors are supplied from the ink tanks 10 to the recording head substrates 4. As the types of colors, for example, black (K), cyan (C), magenta (M), yellow (Y), light cyan (LC), and light magenta (LM) can be used. In each of the recording head substrates 4 of the individual colors, two rows of multiple discharge ports are provided so as to be alternately positioned at an interval of, for example, 600 dpi, thereby configuring rows of discharge ports at an interval of 1200 dpi.

Figure 2:
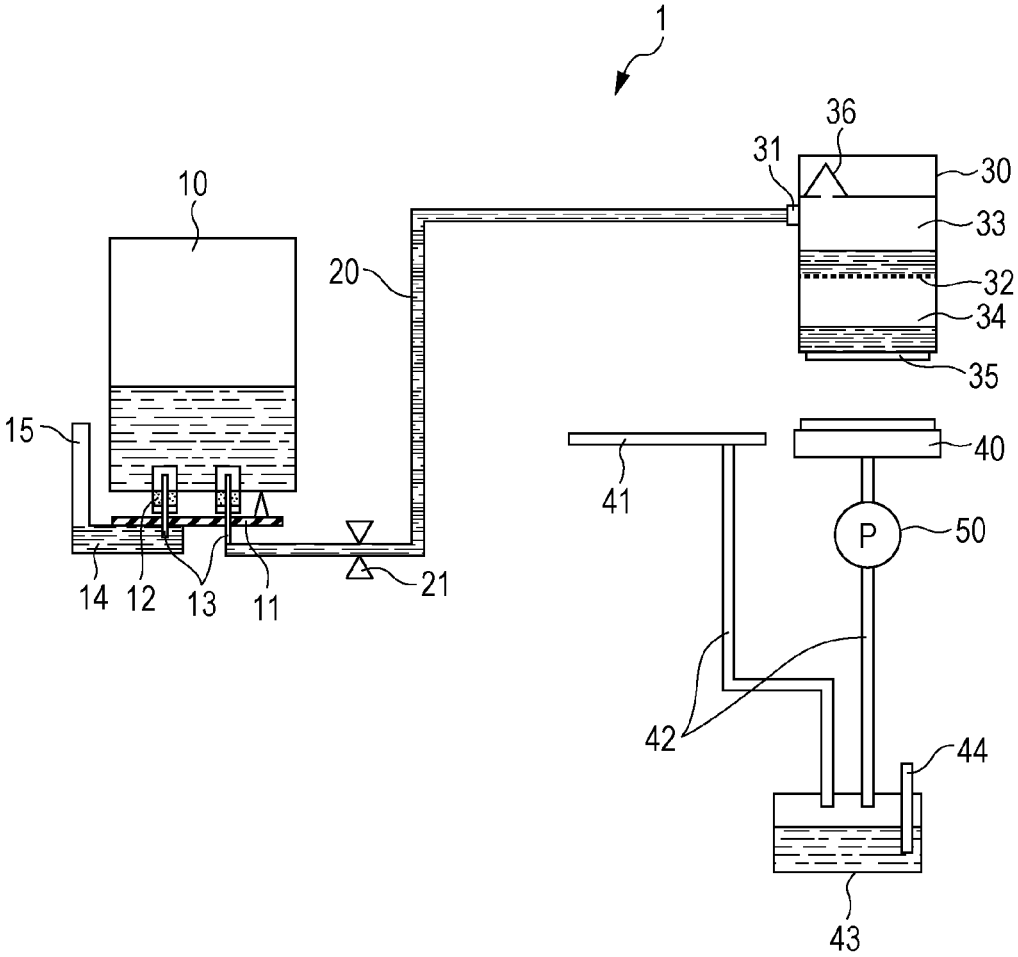
FIG. 2 is a schematic diagram illustrating supplying ink to the inkjet recording apparatus, and a schematic structure of a recovery unit of the inkjet recording apparatus according to the first embodiment.

FIG. 2 is a schematic diagram for describing ink supply and recovery of the recording head 30 in the inkjet recording apparatus 1. Here, to simplify the description, supplying ink of one color will be described by way of example.

In the inkjet recording apparatus 1, ink supplied from one of the ink tanks 10 constituting the ink supply system 8 is supplied via a corresponding one of the ink supply tubes 20 to the recording head 30. The recording head 30 moves reciprocally in the vertical direction in FIG. 2, and discharges ink to a record medium (not illustrated) from multiple discharge ports provided on the discharge port face, thereby performing recording. Ink that has been discharged from the recording head 30 but has not been used for recording (hereinafter may also be referred to as an "waste ink") is firstly collected at the suction cap 40 or the preliminary discharge receiving section 41, and is finally accumulated, via a waste ink collecting pipe 42, in a waste ink tank 43.

The ink tank 10 includes an ink supply connecting section 11 and an atmosphere opening connecting section 12, which are made of rubber. Supply needles 13 are inserted into the ink supply connecting section 11 and the atmosphere opening connecting section 12, thereby supplying ink to the outside. The ink supply connecting section 11 is connected to the ink supply tube 20 via the supply needle 13. In contrast, the atmosphere opening connecting section 12 is connected to a buffer tank 14 via the supply needle 13. An atmosphere opening section 15 is provided at one of two ends of the buffer tank 14. The atmosphere opening section 15 is configured to maintain an atmospheric pressure in the buffer tank 14.

The ink supply tube 20 is formed of a tube made of a flexible member. A valve 21 is provided somewhere on the ink supply tube 20. The flow of ink is controlled by opening/closing the valve 21.

The ink supply tube 20 and the recording head 30 are connected via a joint section 31. A filter 32 for removing dust is provided in the recording head 30. The interior of the recording head 30 is divided, at the filter 32, into a filter upper liquid chamber 33 and a filter lower liquid chamber 34. Ink supplied from the ink tank 10 is stored in each of the filter upper liquid chamber 33 and the filter lower liquid chamber 34. Recording is performed by discharging ink from multiple discharge ports 35. By discharging ink from the multiple discharge ports 35 of the recording head 30, ink in the filter lower liquid chamber 34, which serves as an ink storage section, is consumed, and accordingly, ink in the filter upper liquid chamber 33 flows into the filter lower liquid chamber 34. The reduced amount of ink in the filter upper liquid chamber 33 is compensated for by ink in the ink tank 10 which flows into the filter upper liquid chamber 33.

Because the liquid surface of ink in the buffer tank 14 is positioned on the downside of the discharge ports 35, a negative pressure can be applied to the discharge ports 35. The positional relationship between the buffer tank 14 and the recording head 30 is determined so that the negative pressure value is maintained within an appropriate range. A dynamic pressure caused by a recording operation performed by the recording head 30 is reduced so that the negative pressure is maintained within the appropriate range by expanding/contracting a damper rubber 36 provided in the recording head 30.

The suction cap 40 is formed to have a size capable of covering the discharge port face where the discharge ports 35 of the recording head are provided. During a non-recording operation, the suction cap 40 covers the discharge port face, thereby moisturizing the discharge ports 35. The suction cap 40 receives waste ink discharged by a preliminary discharging operation performed in a recording operation, drives a pump 50, and discards the waste ink in the suction cap 40 to the waste ink tank 43.

Further, the suction cap 40 drives the pump 50 while covering the discharge port face, absorbs ink from the discharge ports 35, and wipes ink in the recording head 30, thereby playing the role of cleaning the interior of the discharge ports 35 and adjusting the amount of ink in the filter upper liquid chamber 33 and the filter lower liquid chamber 34. A waste ink sensor 44 detects whether the amount of waste ink in the waste ink tank 43 is greater than or equal to a threshold.

Figure 3:
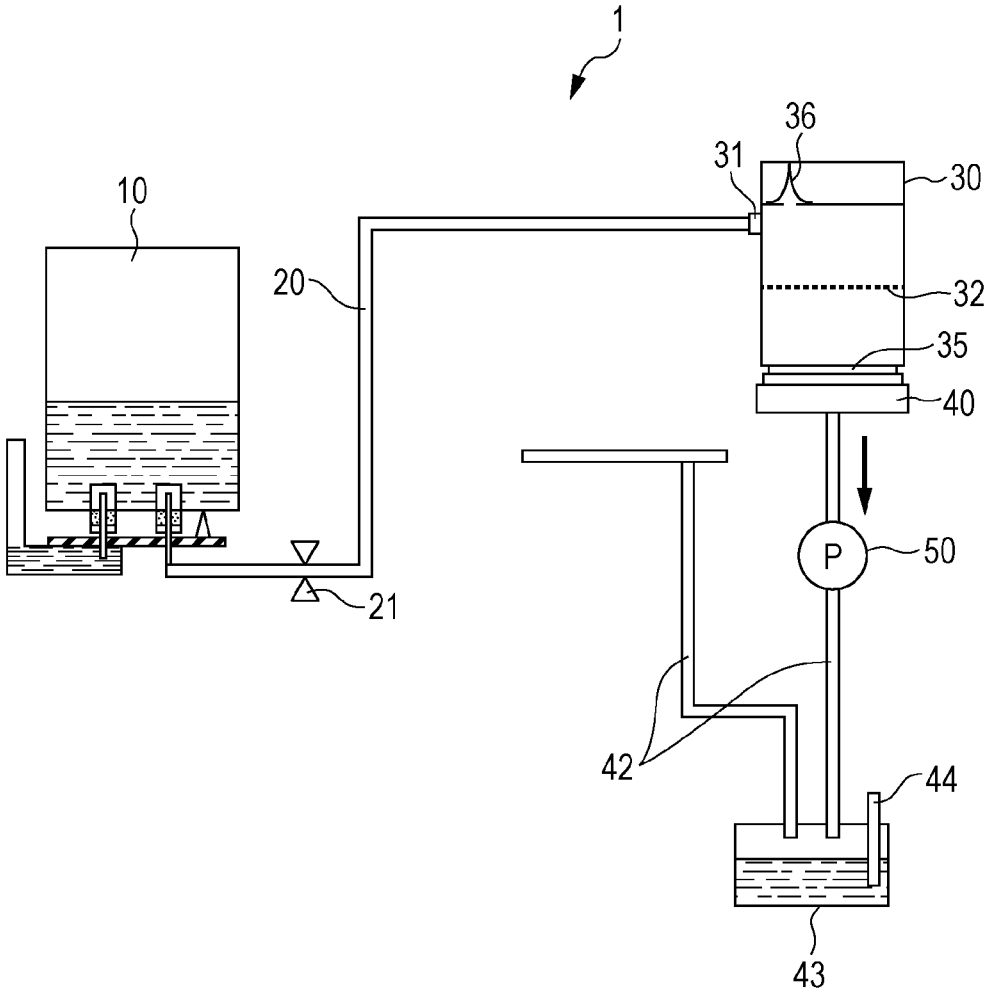
FIG. 3 is a schematic diagram describing a recovery operation in the inkjet recording apparatus according to the first embodiment.

Next, a recovery operation of removing ink left in the recording head 30 and air bubbles accumulated in the recording head 30 and filling the inkjet recording apparatus 1 with new ink will be described with reference to FIG. 3. Firstly, the valve 21, which is provided somewhere on the ink supply tube 20, is closed. Next, the suction cap 40 is raised to seal the face where the discharge ports 35 of the recording head 30 are provided. By activating the pump 50, ink left in the recording head 30 and air bubbles (air) accumulated in the recording head 30 are absorbed in the arrow direction in FIG. 3 and are removed, and the interior of the ink supply tube 20 and the recording head 30 is depressurized. Next, the valve 21 is opened in this depressurized state, and ink in the ink tank 10 flows toward the ink supply tube 20 and the recording head 30, and the ink supply tube 20 and the recording head 30 are filled with new ink. By repeating this ink filling operation, the interior of the ink supply tube 20 and the recording head 30 is filled with a sufficient amount of ink. At this time, the amount of filling ink depends on the depressurized amount achievable by the pump 50.

Such a recovery operation of the recording head 30 is performed when the inkjet recording apparatus 1 is initially installed, when the recording head 30 is replaced, or when the amount of ink is reduced as a result of the fact that air bubbles are accumulated in the recording head 30. When excessive air bubbles are accumulated in the filter lower liquid chamber 34, not enough ink is supplied from the filter upper liquid chamber 33 to the filter lower liquid chamber 34, in response to ink consumption involved in a recording operation, which may cause a large-scale discharging failure. Therefore, it is essential to perform a recovery operation when a certain amount of air bubbles is accumulated in the recording head 30.

Figure 4:
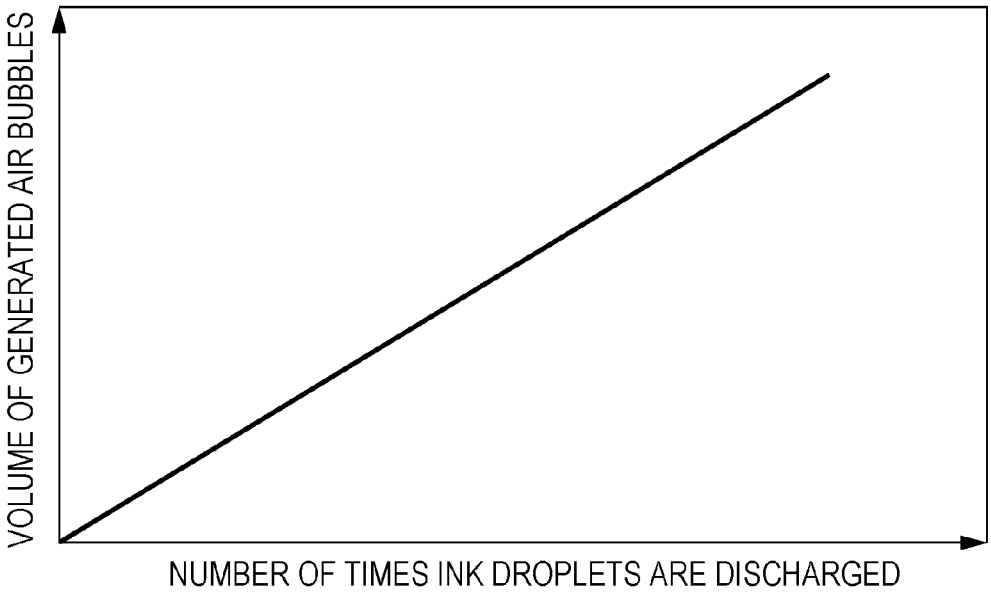
FIG. 4 is a diagram illustrating the relationship between the number of times ink droplets are discharged and the amount of air bubbles generated in an inkjet recording head that discharges ink by utilizing thermal energy.

The causes of the accumulation of air bubbles in the recording head 30 include precipitation of air bubbles dissolved in ink, and air penetrating through members of the recording head 30 and flowing into the recording head 30. In particular, in a method where ink bubbles are generated by utilizing thermal energy generated by turning on an electro-thermal conversion element (heater), and, with the use of the pressure of air bubbles resulting from the ink bubbles, ink is discharged from discharge ports 35, the periphery of the discharge ports 35 becomes hot, and many air bubbles dissolving in ink are generated. Further, some of air bubbles used to discharge ink do not disappear and float in the filter lower liquid chamber 34. Accordingly, air bubbles may be accumulated in the filter lower liquid chamber 34 in accordance with ink discharge. FIG. 4 illustrates the relationship between the number of times ink droplets are discharged and the amount of air bubbles generated in the method of discharging ink by utilizing thermal energy. As illustrated in FIG. 4, air bubbles are accumulated in proportion to the number of times ink droplets are discharged.

Figure 5:
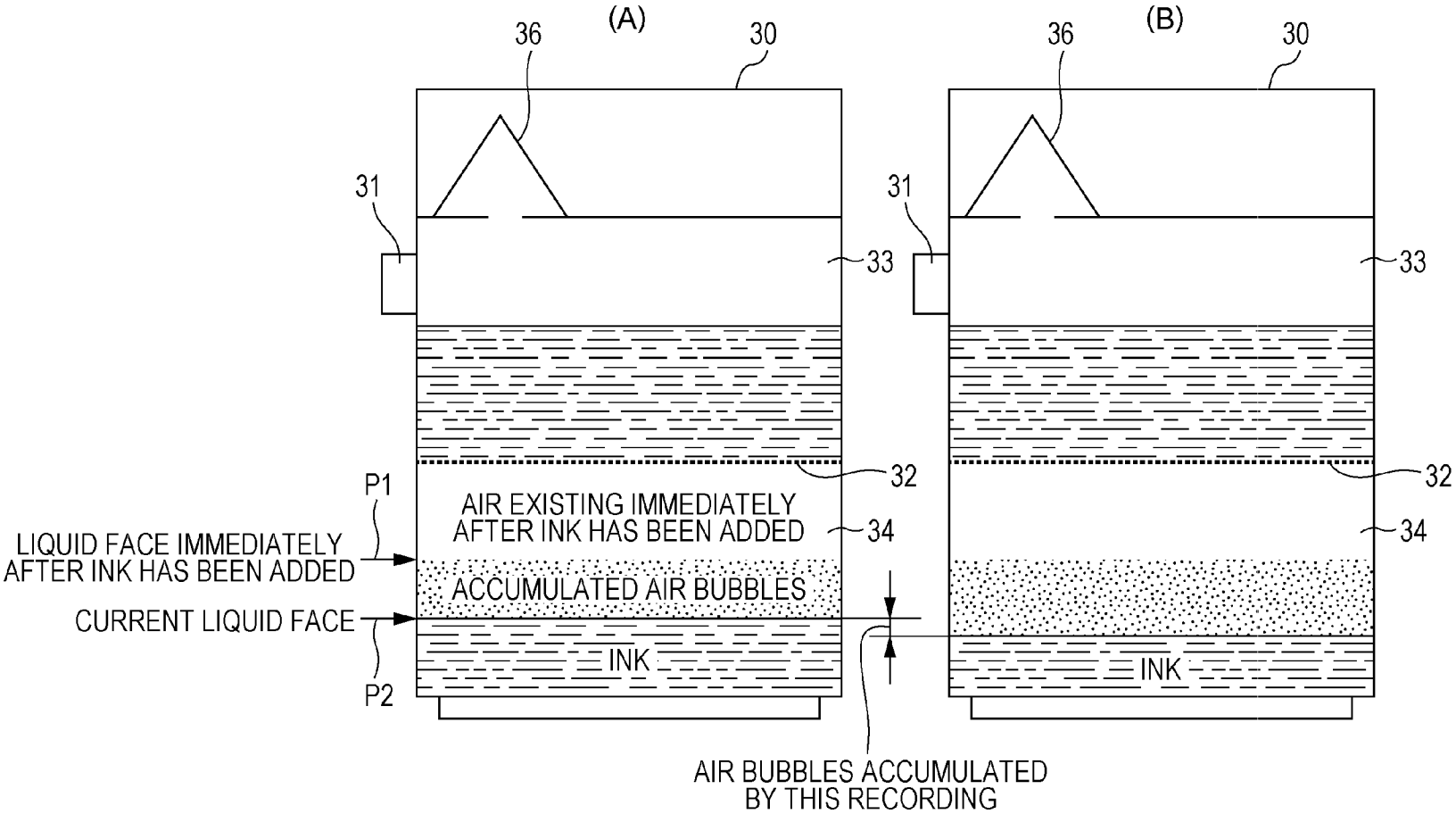
FIG. 5 is a schematic diagram for describing a process of storing air bubbles in the recording head of the inkjet recording apparatus according to the first embodiment.

A process of accumulating air bubbles in the filter lower liquid chamber 34 will be described with reference to portions (A) and (B) of FIG. 5. Portion (A) of FIG. 5 illustrates the amount of ink and an area where air bubbles are accumulated in the recording head 30 at a certain point, after a certain period of time has elapsed since a recording head recovery operation. Because the volume of air bubbles is increased from after a recovery operation to this point, a liquid face P2 of ink is lowered, compared with a liquid face P1 immediately after the recovery operation is performed. By using the relational expression illustrated in FIG. 4, the amount of newly accumulated air bubbles can be estimated by counting, for each ink type, the number of times ink droplets are discharged by the recording head 30 after a recovery operation is performed.

Next, portion (B) of FIG. 5 illustrates the amount of ink and an area where air bubbles are accumulated in the recording head 30 after a certain recording job is performed once in the state illustrated in portion (A) of FIG. 5. The difference between the volume of the air bubble region in the state illustrated in portion (A) of FIG. 5 and the volume of the air bubble region in the state illustrated in portion (B) of FIG. 5 is the volume of the air bubble region resulting from the recording job. This amount can be estimated by using the number of times ink droplets are discharged, which is obtained from the recording job, and the relational expression illustrated in FIG. 4.

When a volume corresponding to the amount of ink in the filter lower liquid chamber 34 prior to a recording operation is less than the volume of air bubbles generated by performing a recording operation in response to a recording job, the filter lower liquid chamber 34 may be filled with air bubbles and a discharging failure may occur during a recording operation.

Therefore, when a volume corresponding to the amount of ink in the filter lower liquid chamber 34 prior to a recording operation is less than the volume of air bubbles generated by performing a recording operation in response to a recording job, interruption of a recording operation can be prevented by performing a recovery operation.

Figure 6:
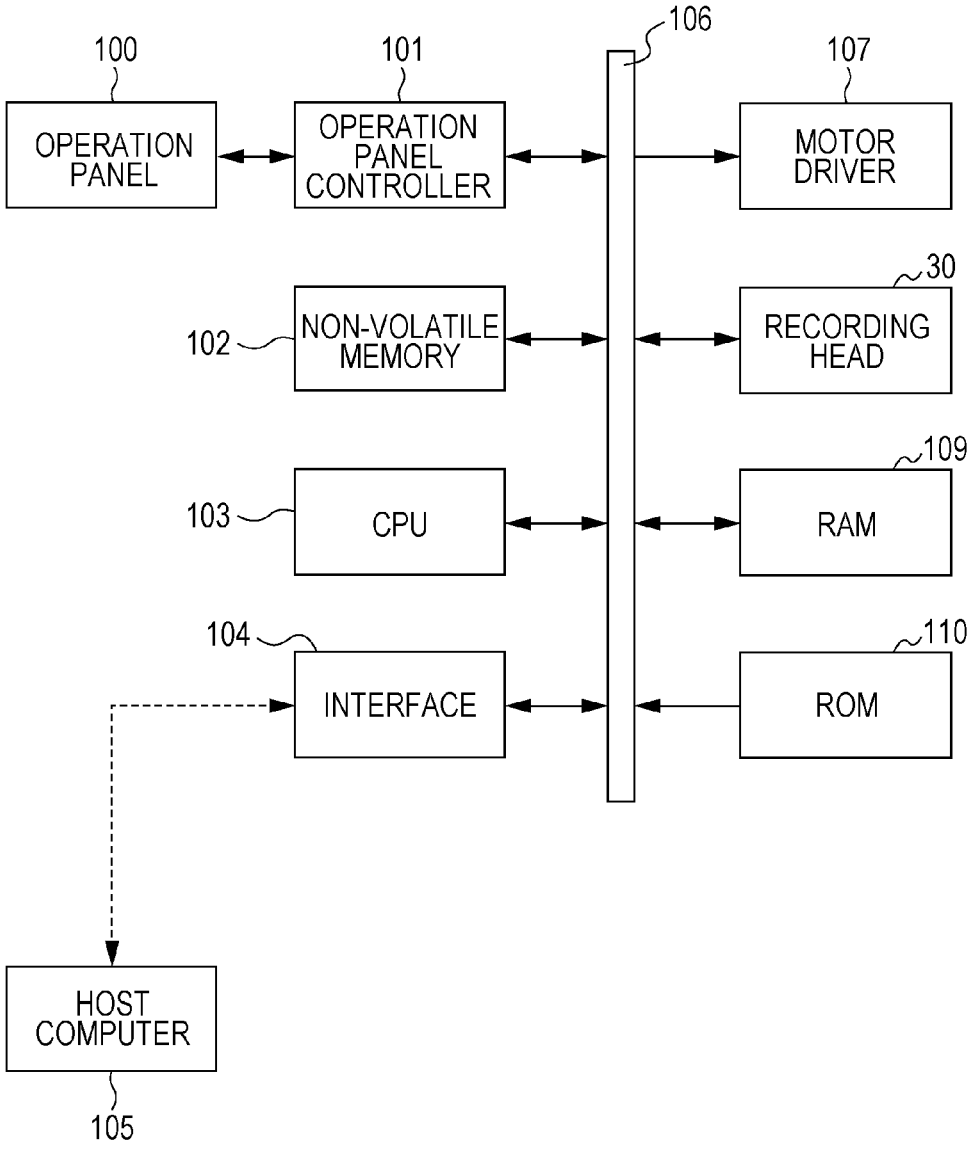
FIG. 6 is a block diagram illustrating the configuration of a control circuit of the inkjet recording apparatus according to the first embodiment.

FIG. 6 is a block diagram of a control circuit of the inkjet recording apparatus 1 according to the first embodiment.

As illustrated in FIG. 6, keys for operation and a display panel are arranged on an operation panel 100. An operation panel controller 101 monitors the state of the keys on the operation panel 100, and transmits an appropriate control command in response to an operated key or keys to the control circuit, including a central processing unit (CPU) 103, of the inkjet recording apparatus 1. Also, the operation panel controller 101 generates a character string to be displayed on the display panel, and controls the display panel. Also, the keys for operation, with which a user can perform key input, are arranged on the display panel. Using the keys for operation, the user can input an operation designation to the inkjet recording apparatus 1, including starting a process of recovery from an error occurrence state.

An interface 104 connects the inkjet recording apparatus 1 to a host computer 105, and has the function of receiving a recording job from the host computer 105 and transmitting a status to the host computer 105. The interface 104 operates as a communication port for data transmission/reception with the host computer 105. The control circuit has the function of connecting the CPU 103 to other devices via a bus 106. A non-volatile memory 102 is a storage element that saves and stores various types of information and is capable of saving the stored information when power supply is cut off. Various types of information include the ink consumption amount of each ink tank 10, the waste ink amount of the waste ink tank 43, the number of non-discharge nozzles, the amount of air bubbles accumulated in the recording head 30 of each color, and the like.

A motor driver 107 is a controller for controlling motors including a carriage motor for performing a recording operation of the inkjet recording apparatus 1 (for activating the recording head 30) and a paper feed motor (which moves a recording sheet and feeds and discharges the sheet). Also, the motor driver 107 controls a recovery motor (which activates a cleaning mechanism and the suction cap 40).

The recording head 30 has the function of discharging ink to a recording sheet from multiple discharge ports 35 and recording an image. In the case of a replacement-type head, each head has a unique head ID. Whether the recording head 30 is replaced with a new one can be determined by comparing the IDs. Also, each recording head 30 has individual differences such as a head rank (the amount of heat generated by members in the head) and a temperature sensor corrected value (a sensor value, corrected for variation, indicating the temperature in the recording head 30). These are checked at the initializing operation of the inkjet recording apparatus 1.

A random access memory (RAM) 109 is a recording device capable of maintaining information as long as power is supplied. When power supply is stopped, the information is lost. A read only memory (ROM) 110 is a read-only storage element, and stores a control program of the inkjet recording apparatus 1. The CPU 103 refers to the control program and performs a control operation.

Hereinafter, the operation status of the control circuit will be described. The CPU 103 of the control circuit reads the control program from the ROM 110, and executes control of each device to be controlled in accordance with the control program. The interface 104 receives a recording job from the host computer 105, and writes the recording job in the RAM 109. On the basis of data written in the RAM 109, the CPU 103 controls the motor driver 107 and the recording head 30 and records recording data on a recording sheet. At that time, information regarding the recording size is added to the head of the recording job. In this way, the CPU 103 is capable of performing a necessary process on the basis of this information before recording starts.

In the present embodiment, calculation of the ink amount and prediction of the volume of generated air bubbles are performed by the control circuit including the above-described CPU 103.

Figure 7:
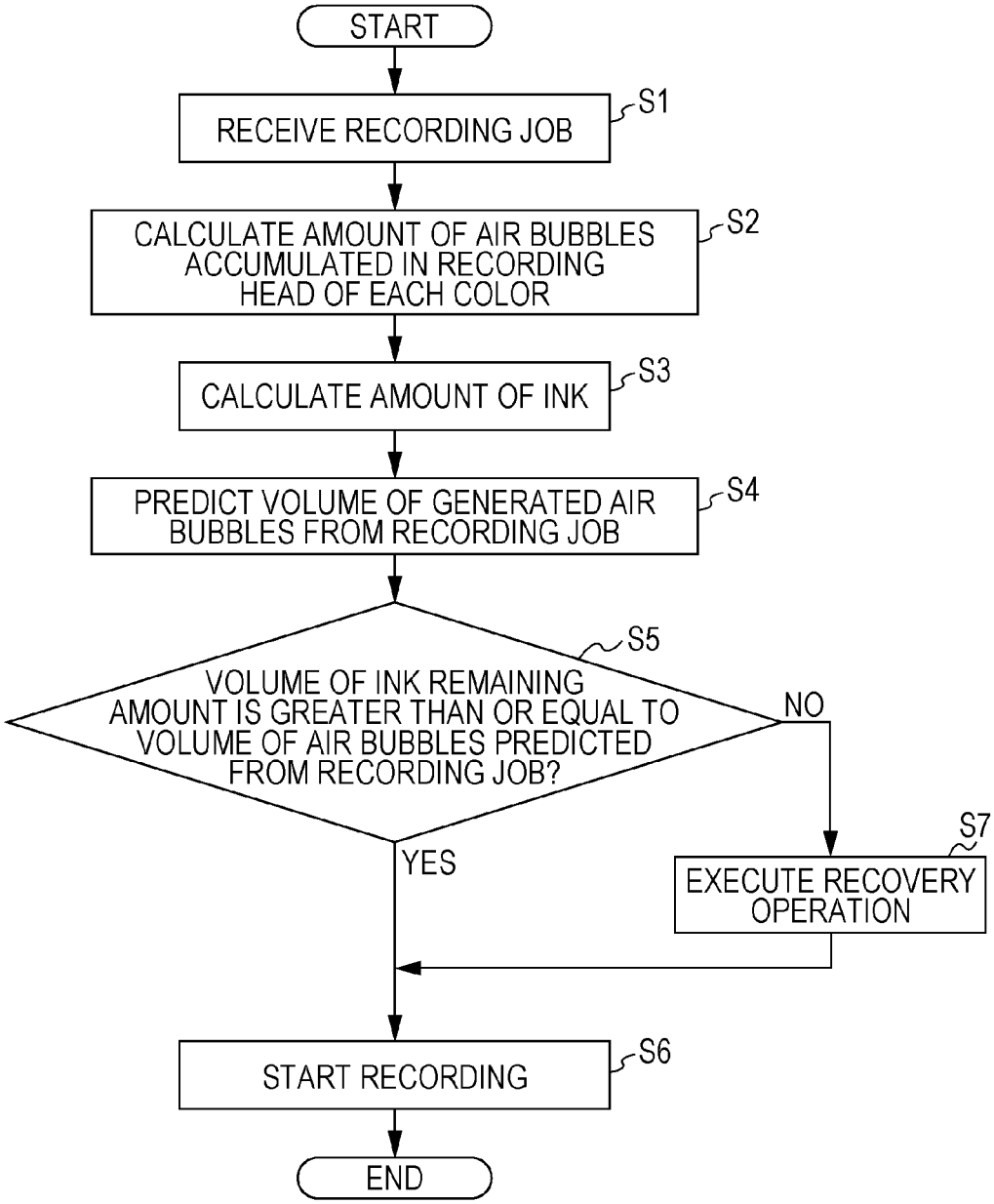
FIG. 7 is a flowchart for determining whether to perform a recovery operation before recording starts according to the first embodiment.

Next, using FIG. 7, a sequence of determining whether to perform a recovery operation will be specifically described. At the time the inkjet recording apparatus 1 receives a recording job (step S1), firstly the inkjet recording apparatus 1 calculates the amount of air bubbles (volume of air bubbles) already accumulated in the recording head 30 of each color (step S2). Specifically, as has been described above, the amount of air bubbles can be calculated on the basis of the number of times ink droplets are discharged from the last time a recovery operation has been performed to that time, by using the relational expression illustrated in FIG. 4. Alternatively, every time a recording job ends, the amount of air bubbles accumulated in the recording head 30 may be calculated, the calculation result may be saved in the non-volatile memory 102, and the value of the amount of air bubbles may be obtained by referring to the saved value.

Next, on the basis of the amount of accumulated air bubbles, the amount of ink in the filter lower liquid chamber 34 of the recording head 30 of a color with the largest amount of air bubbles is calculated (step S3).

Next, using the recording job received in step S1, the volume of air bubbles generated when a recording operation is performed is predicted (step S4). Specifically, with reference to the relational expression illustrated in FIG. 4, a value in accordance with the number of times discharge is performed when recording with an ink duty ratio of 100% (recording ratio of 100%) is performed on a record medium with a size obtained from the recording job is predicted as the volume of air bubbles.

Next, it is determined whether the volume of the amount of ink in the filter lower liquid chamber 34, calculated in step S2, is greater than or equal to the volume of air bubbles obtained in step S4 (step S5). When the volume of the amount of ink in the filter lower liquid chamber 34 is greater than or equal to the volume of air bubbles calculated from the recording job, there is no possibility of the interior of the filter lower liquid chamber 34 being filled with air bubbles and the occurrence of a discharging failure. Thus, no recovery operation is performed, and recording starts (step S6). In contrast, when the volume of the amount of ink in the filter lower liquid chamber 34 is less than the volume of air bubbles calculated from the recording job, the interior of the filter lower liquid chamber 34 may be filled with air bubbles during a recording operation of this recording job, and a large-scale discharging failure may occur. Thus, a recovery operation is performed before recording starts (step S7).

By performing determination of whether to perform a recovery operation, a recovery operation is performed only when necessary. That is, the occurrence of a discharging failure during a recording operation can be prevented, and reduction of the throughput of recording, caused by excessive recovery operations more than needed, can be prevented.

At the time the amount of air bubbles is predicted in step S4, the amount is predicted as the volume of air bubbles generated when recording with an ink duty ratio of 100% is performed with a recording size used in that recording job. Alternatively, the number of times discharge is performed when an image of the recording job is recorded may be obtained, and the volume of air bubbles generated with that number of times discharge is performed may be obtained as the predicted value.

Second Embodiment

The configuration of the recording head 30 according to a second embodiment will be described with reference to FIG. 8. In the first embodiment, the case in which the amount of ink is calculated from the number of times ink is discharged from the recording head 30 has been discussed. In the second embodiment, the case in which an ink amount detector used as an ink amount detecting unit with detection pins 37 serving as conductive needle members is provided in the filter lower liquid chamber 34, and the amount of ink is detected by using this ink amount detector will be discussed.

The ink amount detector has a sensor (not illustrated) serving as a detector that detects whether electricity flows between the detection pins 37 (electrodes). The sensor is electrically connected to the above-described CPU 103. The detection pins 37 include three pins, namely, a first pin 37*a*, a second pin 37*b*, and a third pin 37*c*, which have electrical conductivity. The first pin 37*a*, the second pin 37*b*, and the third pin 37*c* are inserted into the filter lower liquid chamber 34 serving as an ink storage section. Using the fact that ink has electrical conductivity, the ink amount detector determines whether electricity flows between the first pin 37*a* and the third pin 37*c* and between the second pin 37*b* and the third pin 37*c* in response to voltage application.

Figure 8:
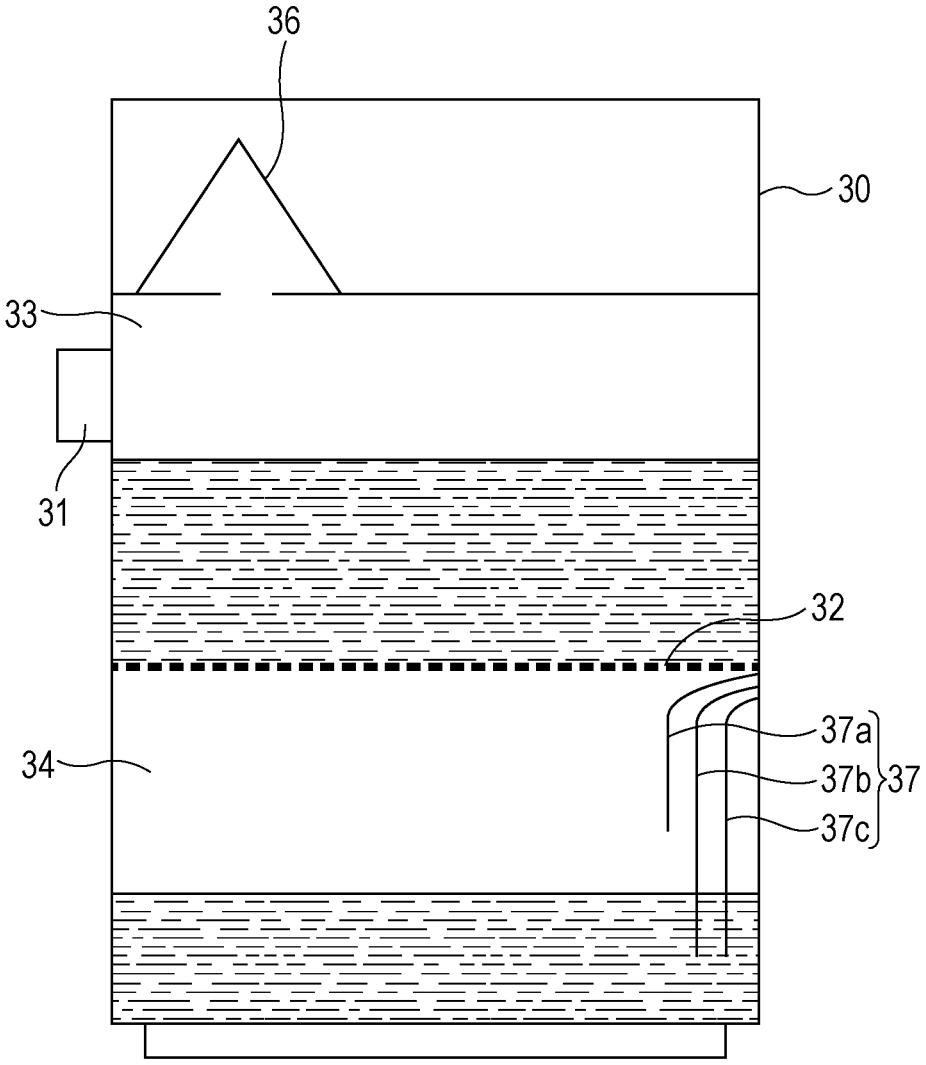
FIG. 8 is a schematic diagram illustrating a schematic configuration of the inkjet recording head according to a second embodiment.

In a state illustrated in FIG. 8, the first pin 37*a* is not immersed in ink. Thus, electrical power is not turned on between the first pin 37*a* and the third pin 37*c*. However, because the second pin 37*b* and the third pin 37*c* are immersed in ink, electricity flows between the second pin 37*b* and the third pin 37*c*. That is, in this case, it is determined that the liquid face of ink is positioned above the position of the bottom of the two detection pins 37*b* and 37*c* and below the position of the bottom of the first pin 37*a*. Alternatively, when power is not turned on between the first pin 37*a* and the third pin 37*c* and between the second pin 37*b* and the third pin 37*c*, it is determined that the ink remaining amount is smaller than the position of the bottom of the second pin 37*b* and the third pin 37*c*. Alternatively, when power is turned on between the first pin 37*a* and the third pin 37*c* and between the second pin 37*b* and the third pin 37*c*, it is determined that the liquid face of ink is positioned above the position of the bottom of the first pin 37*a*.

Here, the minimum ink amount capable of detecting that electricity flows between the first pin 37*a* and the third pin 37*c* serves as a first threshold, and the minimum ink amount capable of detecting that electricity flows between the second pin 37*b* and the third pin 37*c* serves as a second threshold. The ink amount serving as the first threshold corresponds to the volume of air bubbles, predicted to be generated, when the entire region of the maximum recording size recordable with the inkjet recording apparatus 1 is recorded with an ink duty ratio of 100%. The second threshold corresponds to the volume of air bubbles, predicted to be generated, when a recording sheet with a recording size more generally used in the inkjet recording apparatus 1 is recorded with an ink duty ratio of 100%.

Here, a recording sheet with a generally used recording size is defined by the dimensions of the short side and the long side of a quadrangular recording sheet. This recording size is such that the short size is a length equivalent to the maximum recording width in the scanning direction of the recording head 30, which is recordable with the inkjet recording apparatus 1, and the long side is an arbitrary length greater than or equal to 1.29 times the short side. That is, the second threshold is based on a recording size defined by the short side, which is a length equivalent to the maximum recording width in the scanning direction of the recording head 30, which is recordable with the inkjet recording apparatus 1, and the long side, which is an arbitrary length greater than or equal to 1.29 times the short side.

In other words, when the liquid face of ink in the filter lower liquid chamber 34 is lower than the position of the bottom of the first detection pin 37*a*, a recovery operation is performed in accordance with a condition. In contrast, when the liquid face of ink is above the position of the bottom of the first detection pin 37*a*, no recovery operation is performed since a recording operation of the maximum recording size, which is unconditionally ensured to be recordable with the inkjet recording apparatus 1, can be performed.

Figure 9:
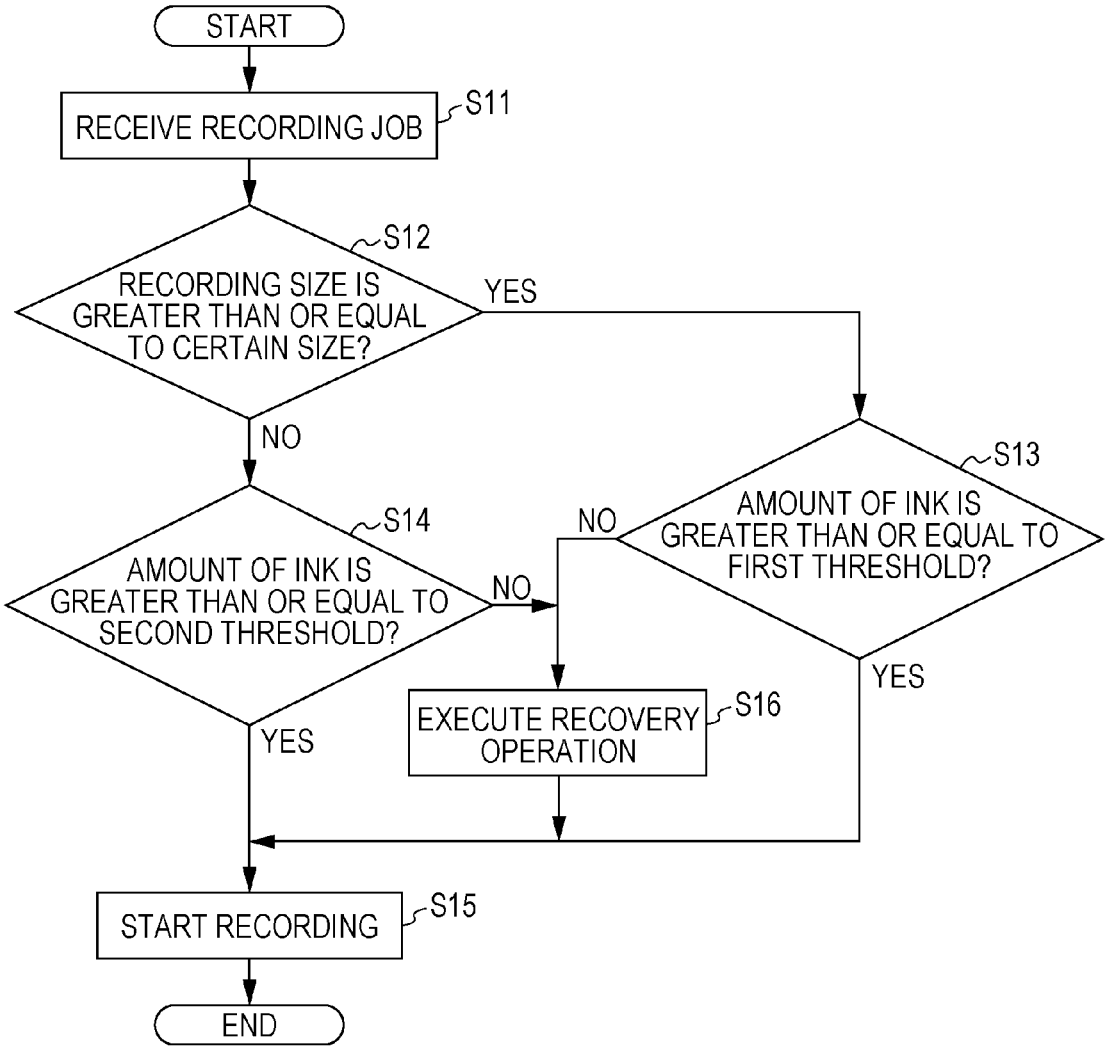
FIG. 9 is a flowchart for determining whether to perform a recovery operation before recording starts according to the second embodiment.

FIG. 9 illustrates a sequence of determining whether to perform a recovery operation before recording starts, according to the second embodiment. As illustrated in FIG. 9, at the time the inkjet recording apparatus 1 receives a recording job (step S11), it is determined whether a recording size used in that recording job is greater than or equal to a certain size (step S12). Here, the recording size of the certain size is the recording size of a generally used recording sheet.

When the recording size used in the recording job is greater than or equal to the certain size, it is determined, for the recording head 30 of each color, whether the amount of ink in the recording head 30 is greater than or equal to the first threshold (step S13). This is determined by using the detection pins 37. When the amount of ink is greater than or equal to the first threshold, no ink discharging failure will occur during a recording operation of any recording size. Thus, a recording operation starts without performing a recovery operation (step S15). In contrast, when the amount of ink is less than the first threshold, there is a possibility that ink is not discharged during a recording operation. Thus, as indicated in step S16, recording starts after a recovery operation is performed (step S15).

When the recording size used in the recording job is less than the certain size in step S12, it is determined, for the recording head of each color, whether the amount of ink in the filter lower liquid chamber 34 is greater than or equal to the second threshold (step S14). This is determined by using the detection pins 37. When the amount of ink is greater than or equal to the second threshold in step S14, no ink discharging failure will occur during a recording operation. Thus, recording starts without performing a recovery operation (step S15). In contrast, when the amount of ink is less than the second threshold, there is a possibility that ink is not discharged during a recording operation. Thus, as indicated in step S16, recording starts after a recovery operation is performed (step S15).

By performing determination of whether to perform a recovery operation, a recovery operation is performed only when necessary. That is, the occurrence of a discharging failure during a recording operation can be prevented, and reduction of the throughput of recording, caused by excessive recovery operations more than needed, can be prevented.

Further, whether the amount of ink is greater than or equal to each threshold can be determined almost at the same time as reception of a recording job. Thus, the time involved in determining whether to perform a recovery operation is reduced.

Note that, in the present embodiment, the example where two thresholds are used has been discussed. However, the number of detection pins may be increased, and determination may be performed by using three or more thresholds. As has been described in the present embodiment, with the use of inexpensive detection pins for detecting whether the amount of ink is greater than or equal to each threshold, determination can be performed accurately while the manufacturing cost can be reduced.

Third Embodiment

Figure 10:
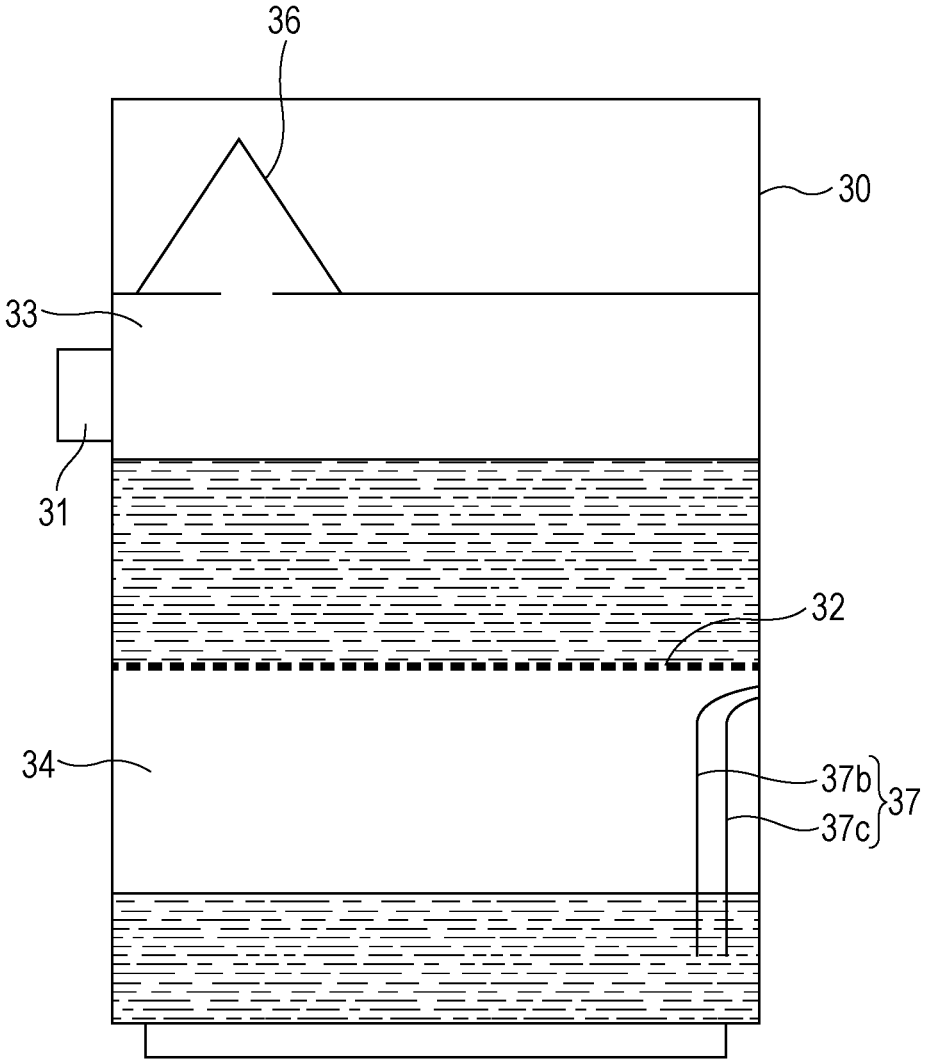
FIG. 10 is a schematic diagram illustrating a schematic structure of the inkjet recording head according to a third embodiment.

The configuration of the recording head 30 according to a third embodiment will be described with reference to FIG. 10. The difference between the third embodiment and the recording head 30 illustrated in FIG. 8 resides in the point that there are only two detection pins 37, and the ink remaining amount is detectable at only one point. As illustrated in FIG. 10, the minimum ink amount capable of detecting that electricity flows between the second pin 37*b* and the third pin 37*c* serves as the second threshold. The second threshold corresponds to the volume of air bubbles, predicted to be generated, when a recording sheet with a recording size more generally used in the inkjet recording apparatus 1 is recorded with an ink duty ratio of 100%. The ink amount serving as the first threshold corresponds to the volume of air bubbles, predicted to be generated, when the entire region of the maximum recording size recordable with the inkjet recording apparatus 1 is recorded with an ink duty ratio of 100%.

Figure 11:
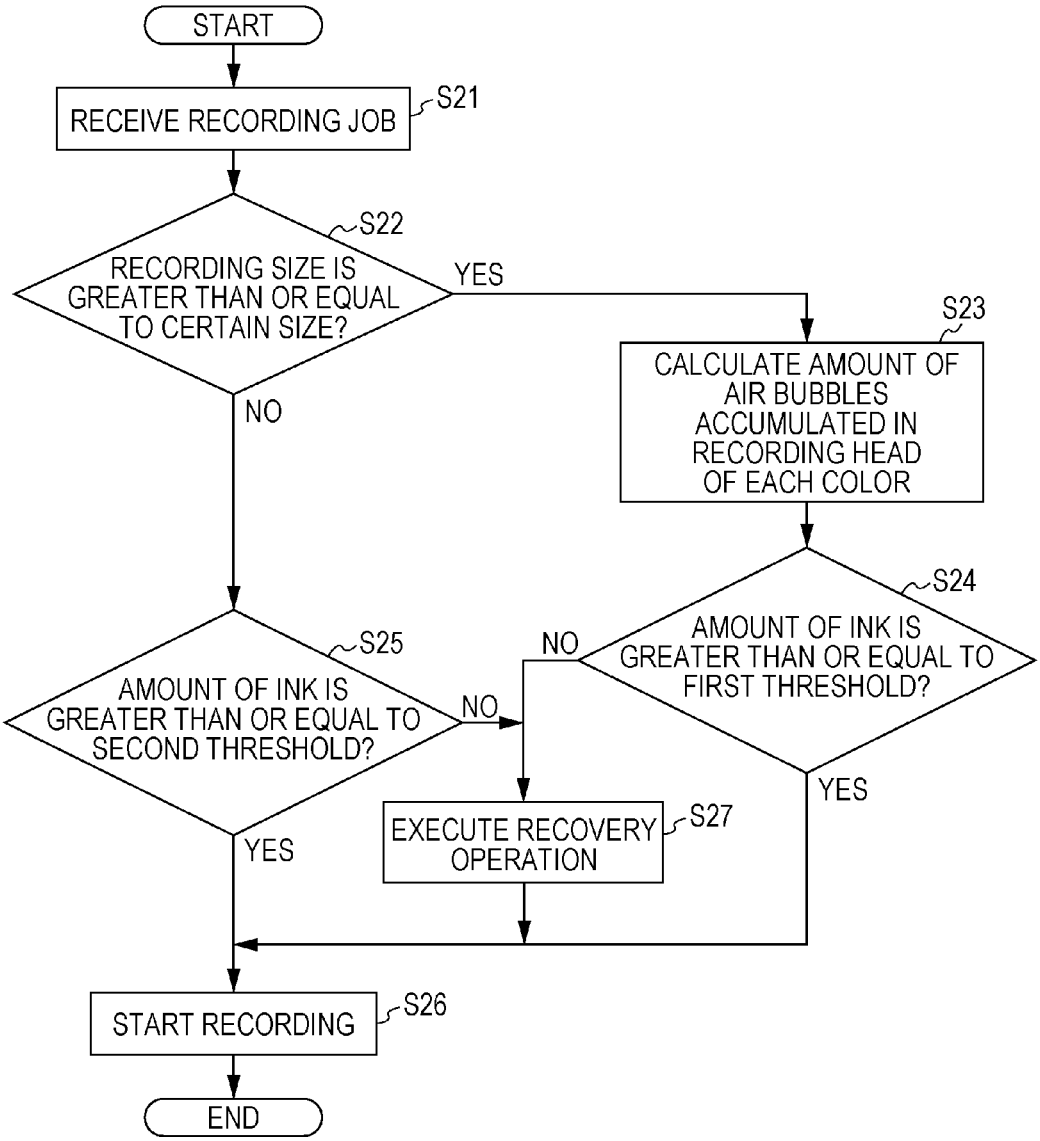
FIG. 11 is a flowchart for determining whether to perform a recovery operation before recording starts according to the third embodiment.

FIG. 11 illustrates a sequence of determining whether to perform a recovery operation before recording starts, according to the third embodiment. As illustrated in FIG. 11, at the time the inkjet recording apparatus 1 receives a recording job (step S21), firstly, it is determined whether a recording size used in that recording job is greater than or equal to a certain size (step S22). Here, the recording size of the certain size is the recording size of a generally used recording sheet. When the recording size is greater than or equal to the certain size, for the recording head 30 of each color, the amount of air bubbles accumulated in the recording head 30 is calculated. The calculation method is as described above. By using the relational expression illustrated in FIG. 4, the amount of air bubbles is calculated on the basis of the number of times ink droplets are discharged from the last time a recovery operation has been performed to that time.

It is determined whether the amount of ink in the filter lower liquid chamber 34, obtained from the calculated amount of air bubbles, is greater than or equal to the first threshold (step S24). When the amount of ink is greater than or equal to the first threshold, no ink discharging failure will occur during a recording operation of any recording size. Thus, recording starts without performing an operation (step S26). In contrast, when the amount of ink is less than the first threshold, there is a possibility that ink is not discharged during a recording operation. Thus, as indicated in step S27, recording starts after a recovery operation is performed (step S26). When the recording size is less than the certain size in step S22, it is determined, for the recording head of each color, whether the amount of ink in the filter lower liquid chamber 34 is greater than or equal to the second threshold (step S25). This is determined by using the detection pins 37. When the amount of ink is greater than or equal to the second threshold, no ink discharging failure will occur during a recording operation of any recording size. Thus, recording starts without adding ink (step S26). In contrast, when the amount of ink is less than the second threshold, there is a possibility that ink is not discharged during a recording operation. Thus, as indicated in step S27, recording starts after a recovery operation is performed (step S26).

According to the third embodiment, the occurrence of a discharging failure during a recording operation can be prevented, and reduction of the throughput of recording, caused by excessive recovery operations more than needed, can be prevented. Further, compared with the second embodiment, because the number of detection pins 37 used can be reduced by one, the manufacturing cost can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-076561 filed Mar. 29, 2012 and No. 2013-045181 filed Mar. 7, 2013, which are hereby incorporated by reference herein in their entirety.

What is claimed is:

1. An inkjet recording apparatus comprising:

a recording head configured to discharge ink;

an obtaining unit configured to obtain an amount of ink in the recording head;

a prediction unit configured to predict, based on an input recording job, a volume of air bubbles generated in the recording head;

an ink tank configured to store ink to be supplied to the recording head;

a filling unit configured to perform a filling operation that fills ink to the recording head from the ink tank; and a controller configured to cause the filling unit to perform the filling operation when the volume of the amount of ink is less than the volume of air bubbles.

2. The inkjet recording apparatus of claim 1, wherein the prediction unit predicts the volume of generated air bubbles based on a number of times discharge is performed when recording with a duty ratio of 100% is performed on a record medium with a recording size obtained from the input recording job.

3. The inkjet recording apparatus of claim 1, wherein the prediction unit predicts the volume of air bubbles generated in the recording head based on a number of times discharge is performed when an image of the input recording job is recorded.

4. The inkjet recording apparatus of claim 1, wherein the obtaining unit obtains the amount of ink in the recording head based on a number of times ink is discharged after a last filling operation has been performed.

5. The inkjet recording apparatus of claim 1, wherein the obtaining unit obtains the amount of ink in the recording head by determining whether electricity flows between a pair of electrodes in response to application of a voltage to the pair of electrodes.

6. The inkjet recording apparatus of claim 1, wherein ink is supplied to the recording head from an ink tank via an ink supply tube.

* * * * *